US006817733B2

(12) United States Patent
Frei et al.

(10) Patent No.: US 6,817,733 B2
(45) Date of Patent: Nov. 16, 2004

(54) INDUSTRIAL MOLDED STRINGLIGHT

(75) Inventors: Rob A. Frei, Bridgeport, WV (US); Scott A. Hagen, Mount Prospect, IL (US); Michael P. Mackin, Chicago, IL (US); Sheena Kantharia, Mundelein, IL (US); Yih-Chyuan Chiou, Wilmette, IL (US); Servando Cedillo, Stone Park, IL (US)

(73) Assignee: Woodhead Industries, Inc., Deerfield, IL (US)

( * ) Notice: Subject to any disclaimer, the term of this patent is extended or adjusted under 35 U.S.C. 154(b) by 1 day.

(21) Appl. No.: 10/103,367

(22) Filed: Mar. 21, 2002

(65) Prior Publication Data

US 2002/0136008 A1 Sep. 26, 2002

Related U.S. Application Data

(60) Provisional application No. 60/277,466, filed on Mar. 21, 2001.

(51) Int. Cl.[7] ..... H01R 33/00

(52) U.S. Cl. ..... 362/226; 362/249; 362/238; 362/252; 362/391; 362/376

(58) Field of Search ..... 362/226, 249, 362/238, 252, 391, 376

(56) References Cited

U.S. PATENT DOCUMENTS

| | | | | | |
|---|---|---|---|---|---|
| 4,441,782 | A | * | 4/1984 | Kneer | 439/340 |
| 5,526,250 | A | * | 6/1996 | Ting et al. | 362/391 |
| 5,622,425 | A | * | 4/1997 | Lin | 362/249 |
| 6,425,682 | B1 | * | 7/2002 | Klaus | 362/376 |

* cited by examiner

*Primary Examiner*—Stephen Husar
*Assistant Examiner*—Bertrand Zeade
(74) *Attorney, Agent, or Firm*—Emrich & Dithmar LLC

(57) ABSTRACT

A light for an industrial stringlight includes a cap having wire channels receiving insulated conductors. Non-interchangeable contact elements are placed in a screw-shell adapted to hold a lamp, and the cap and screw-shell are forced together. The cap is secured to the screw-shell, and insulation-piercing points on the contact elements establish electrical continuity with their associated conductors. The assembly is then overmolded for protection and sealing. A lamp guard is assembled to the overmold and has a bottom section hinged about a horizontal axis to permit replacing the lamp from beneath.

19 Claims, 11 Drawing Sheets

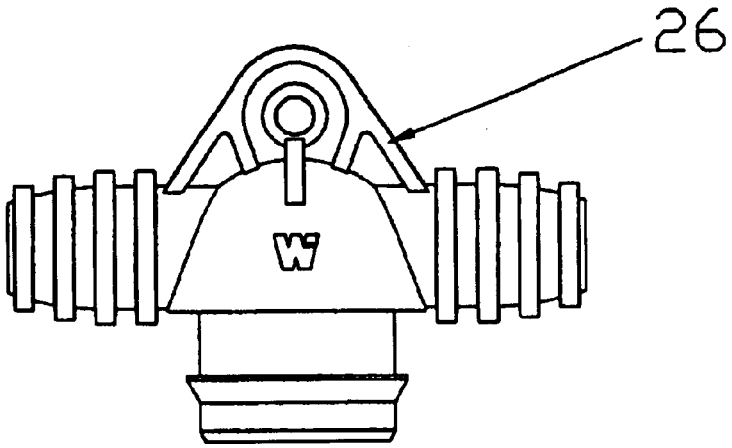
FIG. 5
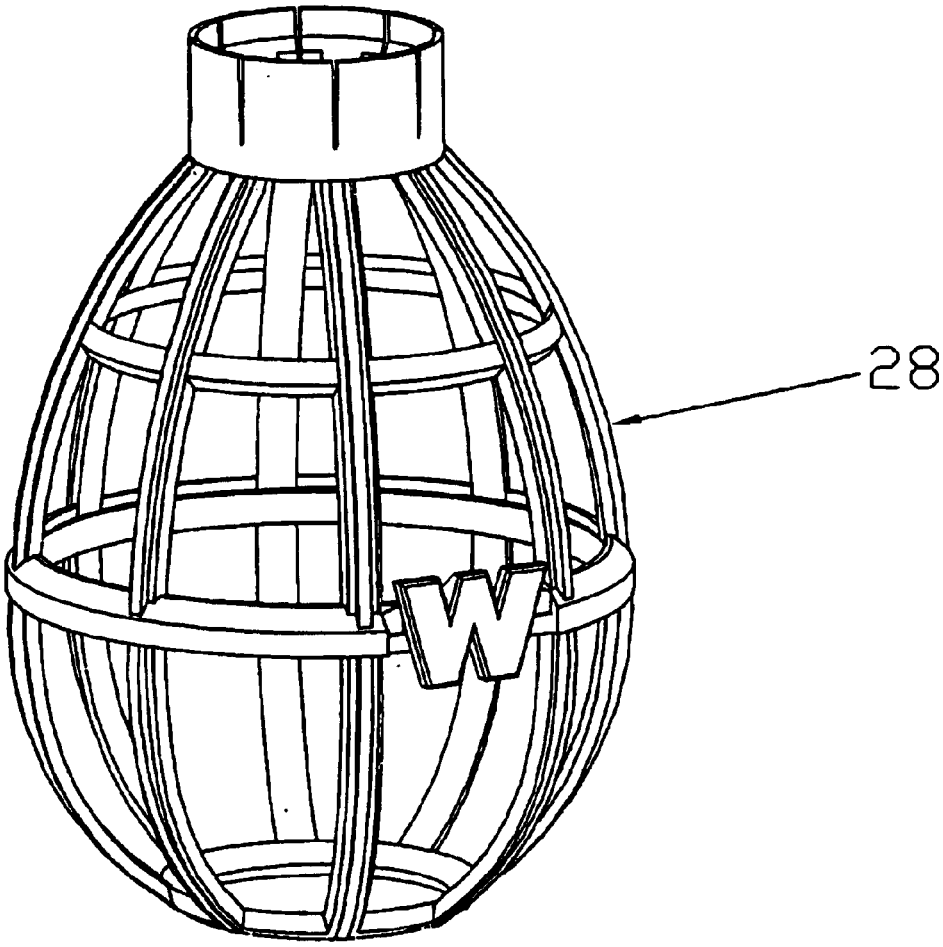

INDUSTRIAL MOLDED STRINGLIGHT

RELATED APPLICATION

This application claims the benefit under 35 U.S.C. 120 of co-pending U.S. Provisional Application 60/277,466 for "Industrial Molded Stringlight Assembly" filed Mar. 21, 2001.

FIELD OF THE INVENTION

The present invention relates to industrial stringlights. Stringlights are used in a wide variety of applications, such as construction sites and large scale manufacturing locations to provide temporary lighting or lighting which may be reconfigured.

BACKGROUND OF THE INVENTION

For industrial applications, it is highly desirable that stringlights be capable of withstanding the rigors of use, particularly at sites such as construction locations or large scale manufacturing plants. Stringlights are frequently moved or they may be bumped by workers or struck inadvertently by objects being carried.

In addition, it is very important that the stringlight assembly be efficient and economical to manufacture, despite the high requirements for ruggedness and quality necessary for industrial applications.

The markets served by stringlights, particularly in the mid-range, requires an economical product, yet one which is suitable for the fairly harsh environments that are typically encountered.

SUMMARY OF THE INVENTION

The present invention provides an industrial molded stringlight including a screw-shell sub-assembly which includes a screw-shell body adapted to receive a wide range of conventional, incandescent lamps. A cap cooperates with the screw-shell body to define a plurality of channels for respective insulated wire conductors.

Insulation-piercing contacts are assembled to the screw-shell. The contacts may include a hot contact, a neutral contact and, if desired, a ground contact. The hot and neutral contacts are designed to be mechanically polarized. By this it is meant that the two contacts cannot be interchanged in assembly to the screw-shell, which, if it were permitted to occur, might create a hazardous condition. Further, the invention contemplates that the ground contact and the associated ground wire are optional without change to the screw-shell or other structure or to the molding process or the molds.

The cap which defines the upper portion of the wire channels, includes a peripheral lip which fits over a corresponding rim on the top of the screw-shell. When the lip of the cap is forced over the rim of the screw-shell, the two are positively coupled together in a manner which firmly engages the wires and causes a reliable piercing of the wire insulation by the contacts, thereby establishing electrical continuity between each wire and its associated contact element. Provision is made in the screw-shell for cavities to receive the insulation of the wire which has been displaced in the assembly/insulation-piercing operation. The tight engagement of the wires by the cap and screw-shell creates a secure, reliable mechanical assembly.

Each contact element, by virtue of its design, has a unique association with the screw-shell so that they may not be mistakenly placed in the wrong location. Moreover, the ground contact includes a peripheral ring received about the outer surface of the screw-shell, and the screw-shell contains a pair of peripheral, axially extended ribs which are spaced to receive the contact element for the ground contact, thereby ensuring proper location of the ground contact relative to the screw-shell, and establishing proper location and orientation of the insulation-piercing point of the ground contact for proper electrical continuity with the ground wire, if one is used.

Other features and advantages of the present invention will be apparent to persons skilled in the art from the following detailed disclosure of the illustrated embodiment accompanied by the attached drawing wherein identical reference numerals will refer to like parts in the various views.

BRIEF DESCRIPTION OF THE DRAWINGS

FIG. 5 is an exploded view of the pre-mold and the lamp guard prior to assembly;

DETAILED DESCRIPTION OF THE ILLUSTRATED EMBODIMENTS

Figure 1:
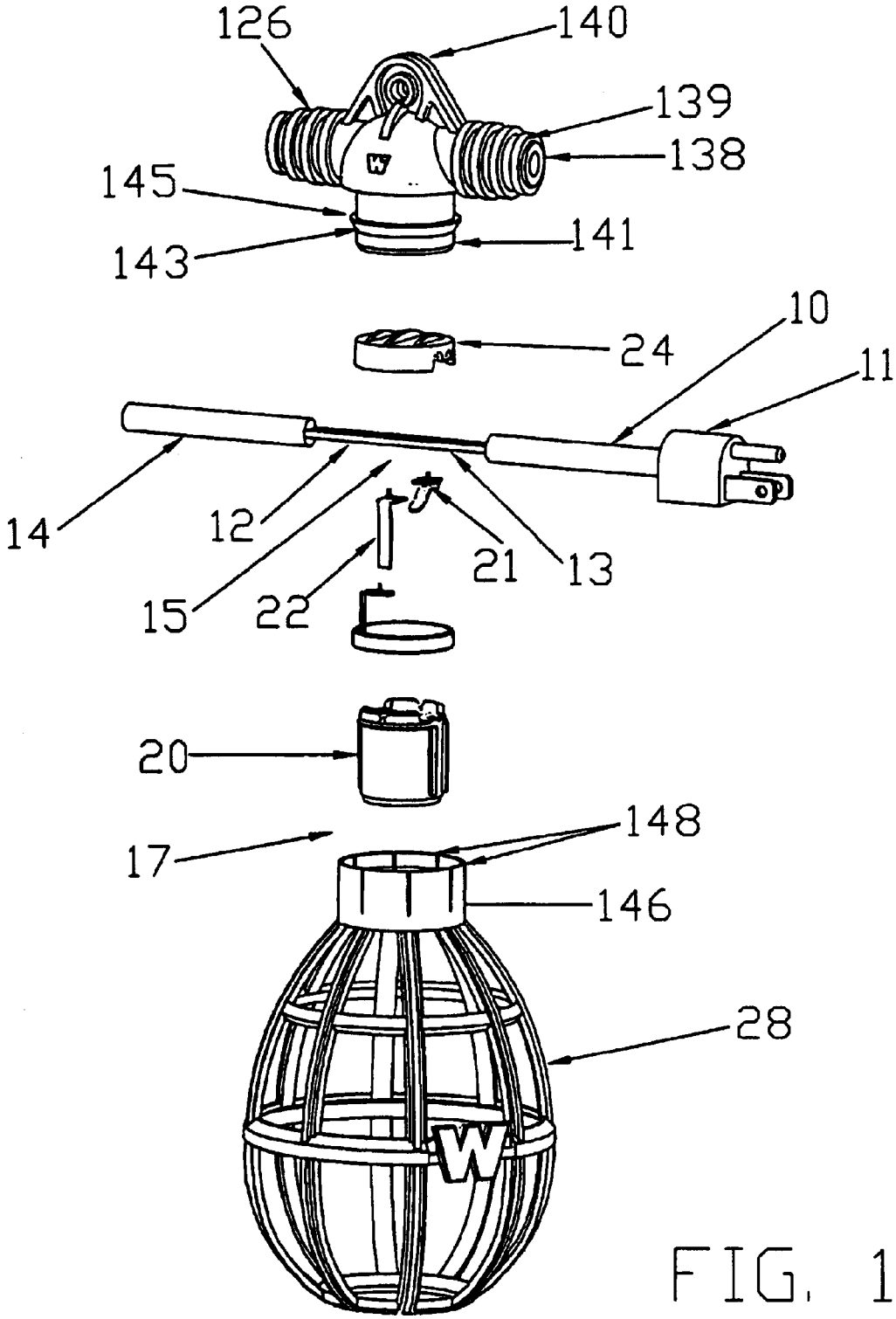
FIG. 1 is a side elevational view of one individual lamp assembly, of a gang of such lights which comprise a stringlight, with the major components in exploded relation, constructed according to the present invention.

Referring first to FIG. 1, the major components or structures of the inventive stringlight will be identified first.

Reference numeral 10 generally refers to a conventional electrical cord including a plug 11, and a plurality of individual wires, two of which are seen in FIG. 1 and designated 12 and 13. The wires 12, 13 are covered by an insulating jacket 14. The insulation 14 is stripped away in the region generally designated 15 to receive an individual lamp assembly which is generally designated by reference numeral 17. Persons skilled in the art will appreciate that a number of individual lamp sockets such as the one designated 17 are spaced at predetermined intervals along the cord 10, thereby forming the "stringlight".

Beneath the cord 10 in the illustration of FIG. 1, is a molded, rigid screw-shell 20 to which are assembled a hot contact 21 and a neutral contact 22. Above the cord 10 in FIG. 1, there is a closure member or cap designated 24 which, during manufacturing, is positively coupled to the top of the screw-shell 20 prior to molding, as will be further described below. An overmold 26 is then applied to the screw-shell 20 and its assembled components, including contacts 21 and 22, as well as to the cap 24, thereby contacting to the wires 12, 13 and covering the stripped section 15 of the cord 10 from which the insulating jacket 14 had been removed.

Figure 3:
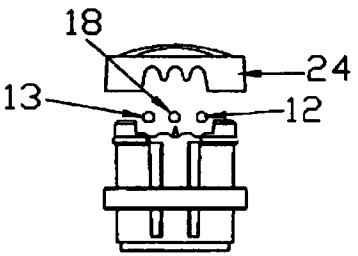
FIG. 3 is a side view of the screw-shell and cap in exploded relation just prior to coupling the cap to the screw-shell and establishing contact with the conductors of the wires of the cable.
Figure 4:
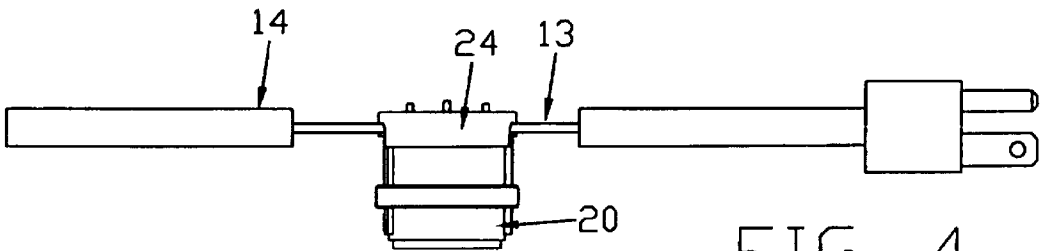
FIG. 4 is a side view showing the cap and screw-shell assembled to the electrical cord prior to overmolding.

Beneath the screw-shell 20 and coupled to the overmold 26 is a lamp guard 28. Before describing the details of the individual components, an overall understanding of the invention may be obtained from FIGS. 2–4.

Figure 2:
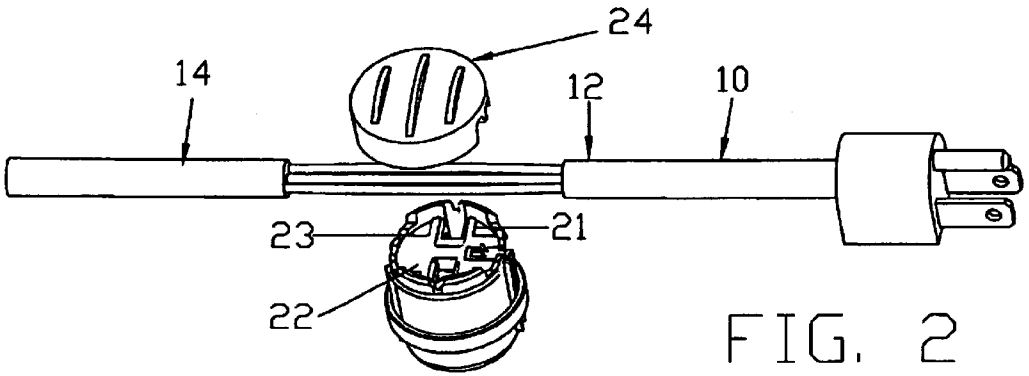
FIG. 2 is an upper perspective view of the screw-shell and cap in exploded relation just prior to assembly to an electrical cord and before applying the pre-mold.

As seen in FIG. 2, the three electrical contacts, namely, the hot contact 21, the neutral contact 22 and the ground contact 23 are assembled to the screw-shell 20. The wires 12, 13 (and in the case of FIGS. 2–4, a ground wire 18) are separated and assembled beneath the cap 24 which contains three channels for the wires 12, 13 and 18, respectively, as will further be described below.

When the wires are assembled in the wire channels, the cap 24 is pressed downwardly into a positive coupling with the screw-shell 20, centering the conductors of wires 12, 13, 18 onto associated piercing members which are associated respectively with the three contacts, and thereby establishing insulation displacement connections between the three contacts and their associated conductors. When the cap 24 and screw-shell 20 are thus positively coupled, they are firmly assembled to the wires in the region where the insulating jacket of the cable had been stripped, and the assembly is ready for overmolding in the shape shown at 26 in FIG. 1.

Figure 7:
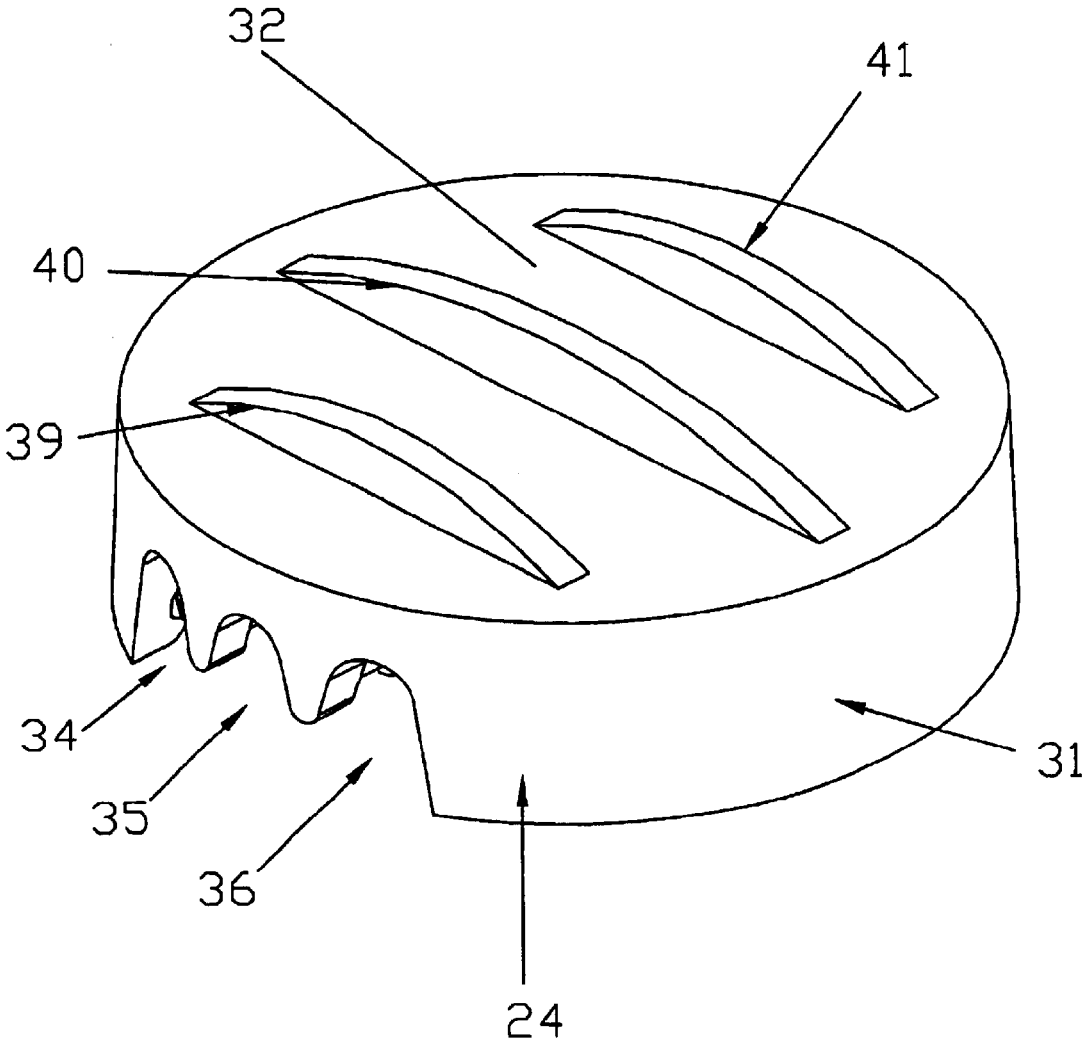
FIG. 7 is a perspective view of the cap which is assembled to the screw-shell.
Figure 8:
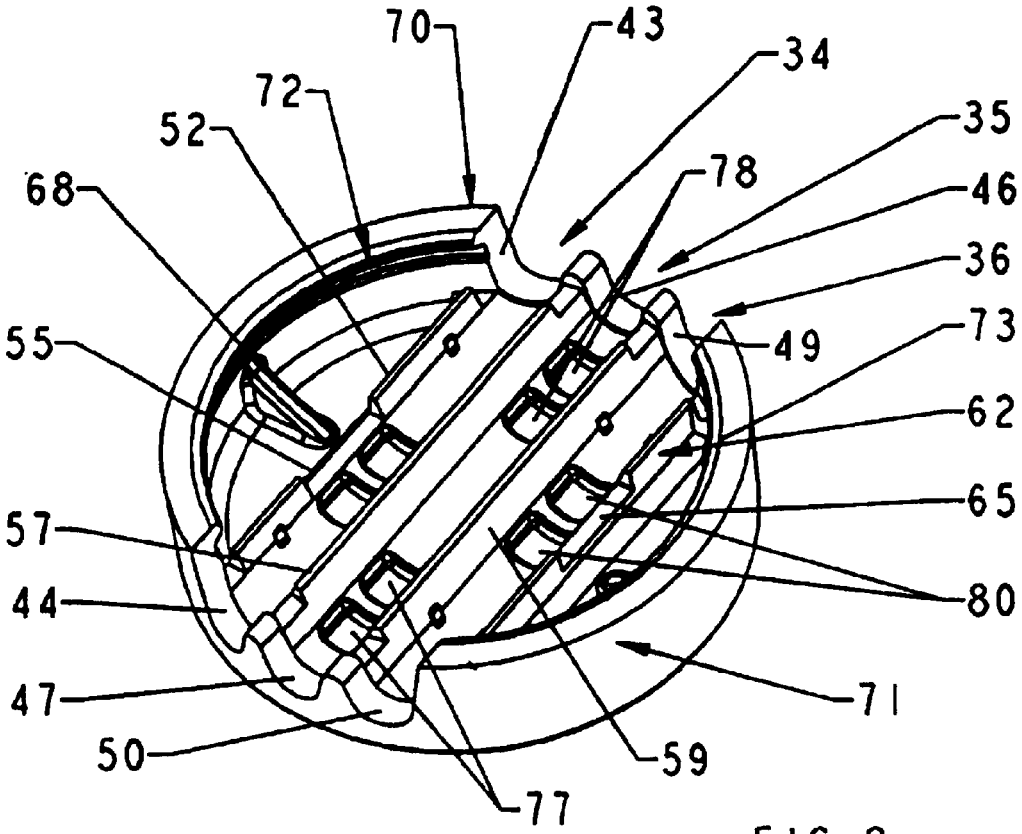
FIG. 8 is a perspective view of the underside of the cap of FIG. 7.
Figure 9:
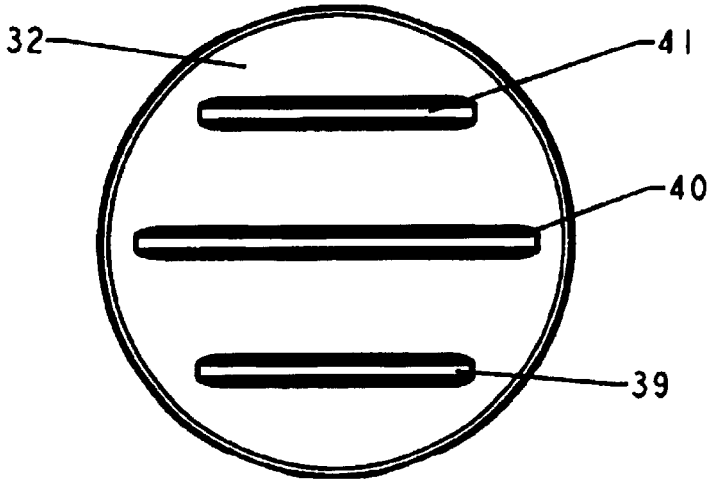
FIG. 9 is a top view of the cap of FIG. 7.
Figure 10:
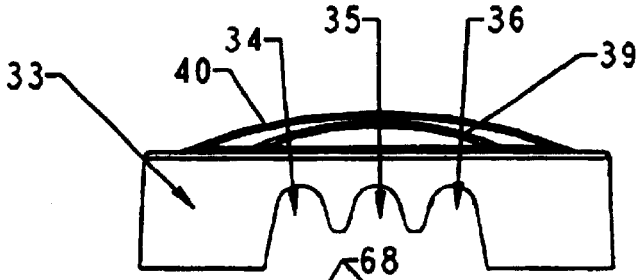
FIG. 10 is a side elevational view of the cap of FIG. 7.

Before describing the overmold further, reference is made to the structure of the cap 24, as seen in FIGS. 7–10. Turning then to those figures, as seen in FIGS. 7 and 9, the cap 24 which may be a rigid plastic such as nylon, includes a top wall 32 and a depending sidewall or skirt 33 which is generally cylindrical in shape and includes diametrically opposing portions defining three wire channels designated respectively 34, 35 and 36 in FIG. 7.

A series of three ribs designated 39, 40 and 41 are integrally molded in the upper surface of top wall 32 to provide strength. The ribs 39–41 extend transverse of the wire channels 34–36. The wire channels 34–36 extend completely through the cap 24. The wire channel 34 includes a first and second curved arches 43, 44 in opposing positions on the sidewall or skirt 33. Similarly, the channel 34 includes diametrically opposing arches 46, 47 and the wire channel 48 includes opposing arches 49, 50. A first sidewall is shown at 52 in FIG. 8, with a reduced center section 55, forms one side of the wire channel 34. The other side of the wire channel 34 is formed by a sidewall 57 which is spaced from the sidewall 52 sufficiently to receive a wire of predetermined size. Similarly, the wire channel 34 is partially formed by the previously described sidewall 57 and a sidewall 59. Finally, the wire channel 36 is partially defined by the sidewall 59, which extends from the interior opposing positions on the depending cap sidewall 33, and a sidewall 62 which, as with sidewall 51, includes a center portion 65 of reduced height.

Figure 11:
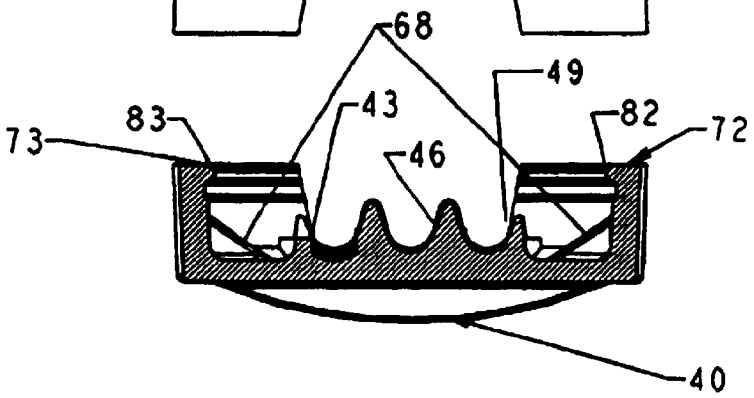
FIG. 11 is a vertical cross-sectional view of the cap of FIG. 7 taken through the center thereof and transverse to the extension of the wire channels.

Strengthening braces, such as the ones designated 68 in FIGS. 8 and 11, may be added to strengthen sidewall 33 and top 32 of the cap. It will be observed that the depending sidewall 33 of the cap is divided by the wire channel openings into opposing sections designated generally 70 and 71 in FIG. 8. Each of the opposing, depending sidewall sections 70, 71 is provided with an inwardly extending rib designated respectively 72 and 73 in FIG. 8 which are used to couple the cap to the screw-shell, as will be described.

Turning to the end wire channel 34, in the bottom surface of the top 32 of the cap 24, there are formed two recesses designated 75 in what is, in effect, the upper wall of the wire channel 34 and, as will later be appreciated, above the insulation-piercing contact element. There are two pairs of similar recesses or cavities designated respectively 77 and 78 in the underside of the cap top wall 32 above the wire channel 35; and a similar pair of recesses 80 are formed in the underside of the top 32 above the wire channel 36.

As best seen in FIG. 11, the innermost edges of the ribs 72, 73 form a slight edge designated 83 and 84 respectively. The edges 83, 84 form lips which firmly fit beneath corresponding outwardly extending ribs on the screw-shell 20 as will be described presently. As seen from FIGS. 10 and 11, the arches which form the wire channels are radiused to receive the associated wires in snug engagement.

It will be observed from FIG. 8 that the strengthening braces 68 extending diametrically of the cap 24, and the recesses 75 are offset toward one side, whereas the recesses 80 of the wire channel 36 are offset to the opposite side, toward the right in FIG. 8. Moreover, the pairs of recesses 77, 78 are located corresponding distances from the arches 47, 46 respectively. The purpose of this arrangement is to make the cap 24 symmetrical relative to the insulation-piercing tines or points on the three electrical contact elements, as will be described below. The piercing point is located and designed to press against the underside of the wire insulating jacket in the location between adjacent recesses, permitting the flexible, pliable insulating jacket of the wire to extend into the associated recesses, thereby establishing and maintaining a firm engagement between the piercing element and the interior conductor of the wire while permitting the insulating jacket of the wire to be displaced into and occupy the associated recesses. This maintains a constant, firm contact between the wire jacket and the associated wire channels, and reduces any open space inside the wire channels once they are occupied by the wires. Moreover, the recesses 55, 65 of the end channel walls 52, 62 also permit wire or insulation to move laterally relative to the associated wire channels during the piercing operation, as will be apparent from further description.

Figure 12:
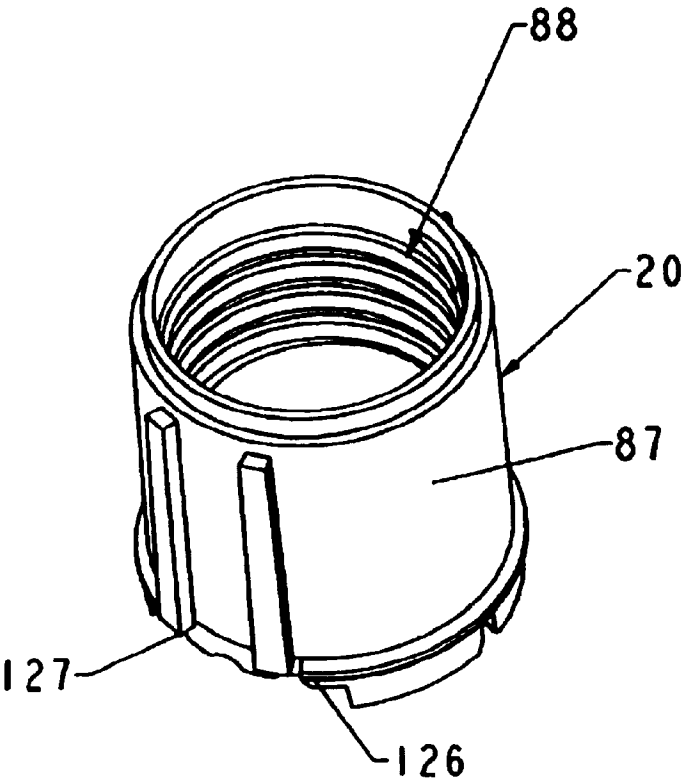
FIG. 12 is a perspective view of the screw-shell with the screw-shell inverted.
Figure 15:
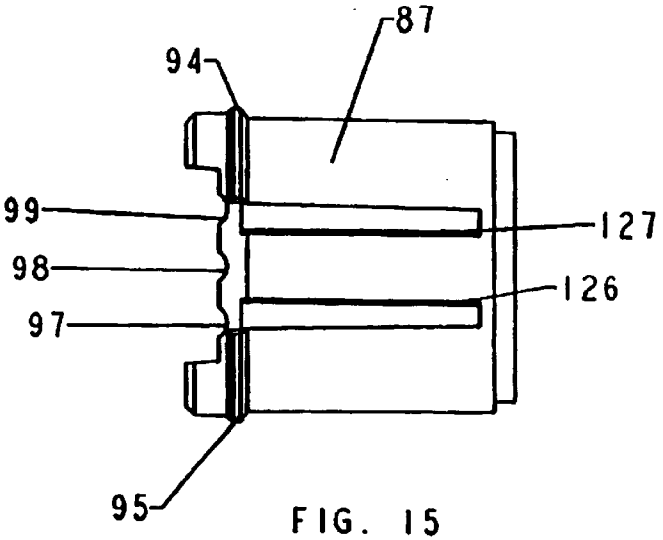
FIG. 15 is an elevational side view of the screw-shell.
Figure 14:
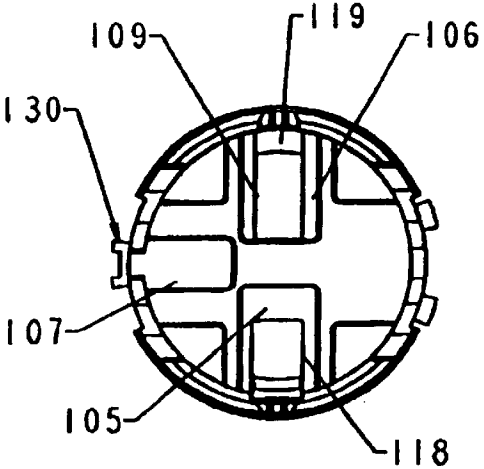
FIG. 14 is a top view of the screw-shell.
Figure 16:
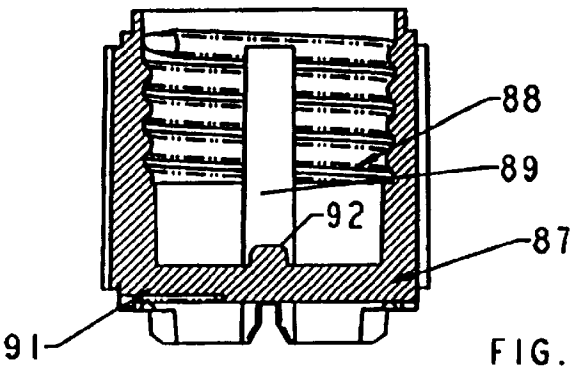
FIG. 16 is a cross-sectional view of the screw-shell taken through a vertical plane and showing the slot for receiving the connector tab of the neutral contact.

Turning now to FIGS. 12–16, the screw-shell 20 includes a generally cylindrical sidewall 87, which has molded into its interior surface a helical thread designated 88 in FIGS. 12 and 16. The thread 88 is sized to receive a range of conventional incandescent lamp bases, and it is continuous except for an axial slot shown at 89 in FIG. 16, the purpose of which is to accommodate the neutral connector element, as will be described. The screw-shell 20 has a top wall 91 formed integrally with the sidewall 87. The lamp normally extends or hangs downwardly; hence the wall 91 is considered the top wall. The center portion of the top wall is formed into a projection 92 which is located to engage and support the pad 113 of the hot contact element 112 (FIGS. 19, 20) when the hot contact element is assembled to the screw-shell 20, as will be further described below. This ensures good electrical contact with the lamp base.

Figure 13:
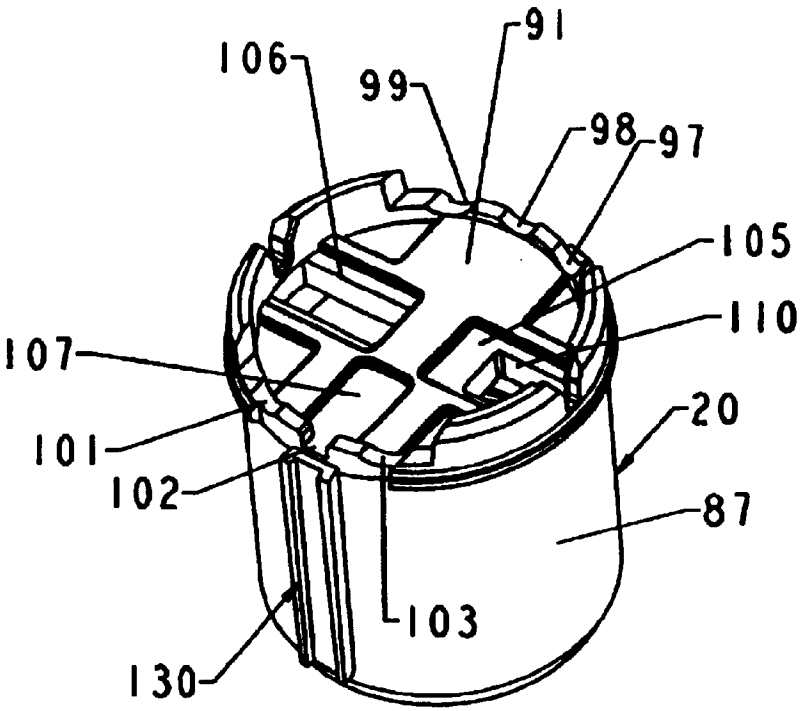
FIG. 13 is an upper perspective view of the screw-shell.

Referring to FIGS. 12, 13 and 15, at the top of the cylindrical wall 87, there are formed first and second partial rims or lips 94, 95. The rims 94, 95 engage with the corresponding ribs 72, 73 of the interior rims on the cap. That is, as the cap 24 is pressed down on the top of the screw-shell 20, the inwardly extending ribs 72, 73 of the cap are forced over the corresponding rims 94, 95 on the screw-shell, and the inwardly extending edges 83, 84 of the ribs 72, 73 extend below the rims 94, 95 of the screw-shell, thereby coupling the two members together, and forcing the wires into tight engagement with both the cap and the screw-shell. The wires are secured by corresponding curved recesses 97, 98 and 99 formed on one side of the cylindrical wall 87, and recesses 101, 102 and 103 formed on the opposing side of the sidewall 87. The recesses 99, 101 are aligned to receive one insulated wire. The recesses 98, 102 are also aligned to receive the center wire and recesses 97, 103 are aligned to receive the other wire. This arrangement of aligned recesses in the cap and the screw-shell, once the cap is properly assembled to the screw-shell, ensure that the wires are also properly positioned and secured for piercing by the point members on the corresponding connector elements, as will now be described.

The top wall 91 contains three recesses forming receptacles for the connector elements, designated respectively 105, 106 and 107. Recess 106 receives and seats the hot contact element, recess 105 receives and seats the neutral contact, and recess 107 receives and seats the ground contact element.

Figure 19:
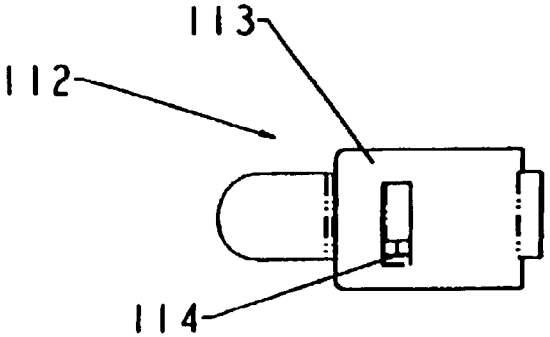
FIGS. 19 and 20 are top and side views respectively of the hot contact.
Figure 20:
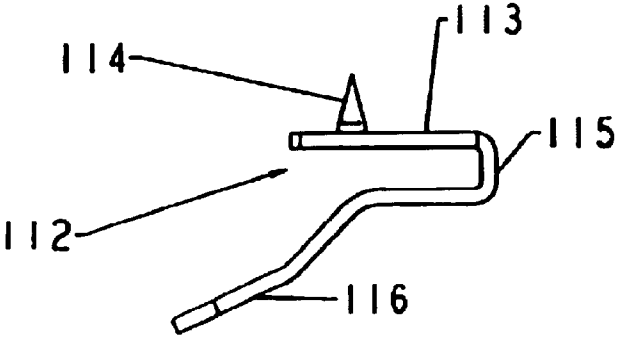

Turning first to the recess 105, it includes an aperture 110 extending through the top wall 91 of the screw-shell and into which is placed the hot contact element 112 seen in FIGS. 19 and 20. The hot contact element includes an upper, flat pad 113 out of which is stamped a pointed piercing element 114. The contact element is then bent around at 115 to fit over the reduced portion of the top wall 91. The contact element is then formed downwardly and at an incline 116 forming a pad or flat for engaging a corresponding contact element on a lamp base inserted in the socket. The pad 116 is supported by projection 92 of the base to promote better electrical contact with the base of a lamp inserted in the socket. It will be observed from FIGS. 14 and 19 that the depending portion of the hot contact, including elements 115 and 116 are offset to one side relative to the upper pad 113. The pad 113 is received snugly in the recess 105, and the aperture 118 which receives the depending portion of the contact element is also offset relative to the center of the recess 105 so that the contact 112 is snugly but firmly seated and supported. By contrast, as will be described presently, the corresponding pad and depending contact element for the neutral connector is similarly asymmetrically designed and the footprints of the respective pads 113, 121 are of different dimensions so that the two contact elements, neutral and hot, are not interchangeable in their respective receptacles in the top wall 91 of the screw-shell.

Figure 17:
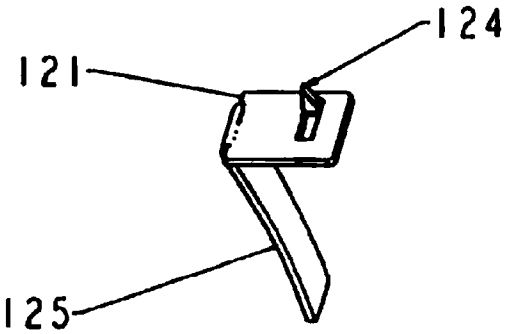
FIGS. 17 and 18 are top and perspective views respectively of the neutral contact.
Figure 18:
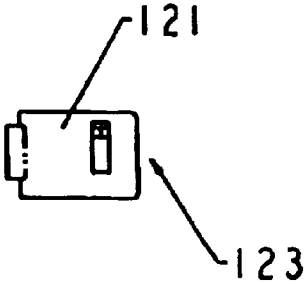

Turning then to recess 106, it includes an aperture 119 extending entirely through the top 91 of the screw-shell. The recess 106 receives a pad 121 of the neutral contact element 123. A pointed piercing element 124 is stamped from the pad 121 and a downwardly depending strip 125 extends through the opening 119 and into alignment with the previously described slot 89 (FIG. 16) formed in the screw threads on the interior surface of the sidewall 87 of the screw-shell. As indicated and as seen in FIG. 17, the centerline of the depending tab 125 is offset relative to the centerline of the pad 121, and this offset corresponds to the offset between the centerline of the opening 109 relative to the recess 106 which receives the neutral contact element.

Turning now particularly to FIGS. 12, 13, 14 and 15, on the outside surface of the sidewall 87, there are molded a pair of generally parallel, straight ribs 126, 127 which are relatively widely spaced, as seen in FIG. 16, and which begin at their upper end adjacent the ends of the peripheral ribs 94, 95 and extend downwardly therefrom.

On the outer surface of the sidewall 87 opposite the straight ribs 126, 127, there is a channel member 130. As best seen in FIG. 13, the channel member, which extends parallel to the axis of the sidewall 87, and has its upper end adjacent the arched recess 102 receiving the center wire, which, when used, is the ground conductor. The ground wire thus passes across the center of the contact receptacle 107. The ground contact, as seen in FIGS. 21 and 22, includes a cylindrical band 132 which is sized to be received on the exterior of the screw-shell, the interior of the ring 132 snugly engaging the outer surfaces of the ribs 126, 127 and the projecting sides of the channel member 130.

Figure 21:
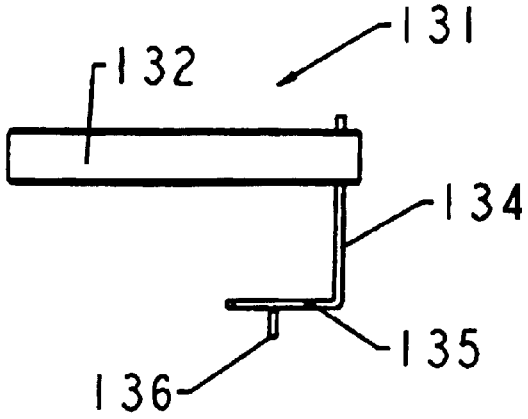
FIG. 21 is a side view of the ground contact.
Figure 22:
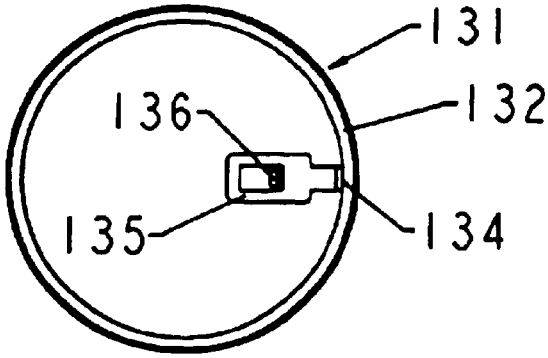
FIG. 22 is a top view of the ground contact of FIG. 21.

Fixed to the interior of the metal band 132 is an L-shaped extension member 134 which extends upwardly of the band 132 (shown inverted in FIG. 21). At the upper end of the extension 134, there is an angled pad 135 in which there is stamped a piercing point 136. The width of the extension member 134 (see FIG. 22) is equal to the interior width of the channel 130. Thus, the ground conductor 131 is placed on the outer side of the screw-shell 20 with the extension 134 aligned with the slot in the channel member 130. When the ground conductor is thus assembled to the screw-shell, the pad 135 is received in the recess 107, with the piercing point 136 properly aligned with the center of the center conductor received in the arched wire recesses 98, 102 for proper piercing and establishment of electrical continuity between the ground contact and the ground wire of the stringlight assembly when the cap is pressed onto the screw-shell.

The assembly and operation of the cap, electrodes, wire and screw-shell will now be apparent to those skilled in the art. However, briefly, with the neutral, hot and ground contact elements properly assembled to the screw-shell, as described above, the piercing elements associated with each of the three contact elements is properly aligned along the center of the associated wire channel. The wires are assembled in the cap in the associated, mating wire channel, and the cap is then pressed onto the screw-shell with the interior ribs of the cap being forced over the outer rims 94, 95 of the screw-shell, and such that the inwardly extending edges 83, 84 of the inner ribs 72, 73 of the cap firmly coupling to the screw-shell to couple the two members together. During the course of this assembly, which may be effected with mechanical or pneumatic assist, the wires are pierced by the associated piercing members and the wires are also compressed, deforming the insulation of the wires in order to ensure proper electrical contact, and the insulating jacket is forced into the recesses 75 and 80 of the outer wire channels 34, 36 and, as described, one of the recessed pairs 77, 78 in the central wire channel 35.

This assembly of cap, wires, contact elements and screw-shell are then placed in a molding machine and the overmold 26 is then formed over the assembly and down about the lower edge of the screw-shell 20. Referring back to FIG. 1, it can be seen that the overmold 26 includes first and second laterally extending arms 138, 139 which are peripherally ribbed for bulk and strength and to facilitate handling. The arms 138, 139 are molded about the cord 10 on either side of the stripped area 15 and overlapping on the outer cord jacket 14. The overmold 26 includes an apertured mounting flange 140 and central hub 141 which forms a covering for the outer surface of the screw-shell 20, and the molding material permeates all interstices between the cap and wires, between the cap and screw-shell, and between the ground conductor and outer surface of the screw-shell, as well as the space between the straight ribs 126, 127. That is, all interior spaces are filled with the molding material, which maybe a melt-processable rubber, and this is an important features because it adds durability, sealing and strength to the assembly and it seals the connections.

About the exterior of the downwardly extending body 140 is a peripheral flange 143 having a frusto-conical surface 144 and a generally radial upper, flat surface 145. Lamp guard 28 has an upper latching collar 146 which is partially slotted in the vertical direction at 148 to provide coupling tabs between adjacent slots. The tabs will thus flex outwardly when force is applied. When the lamp guard 28 is assembled to the molded body 140, the tabs flex. A corresponding barbed inner rim (formed on the upper inner edge of the tabs) rides over the frusto-conical surface 144 of the flange 143 to flex the tabs which are seated on and held by the planar annular flange 145, thereby securing the lamp guard to the assembly. One advantage of the segmented latching collar 146 is that it may be secured to several different socket assemblies since the latching engagement may be released.

Figure 6:
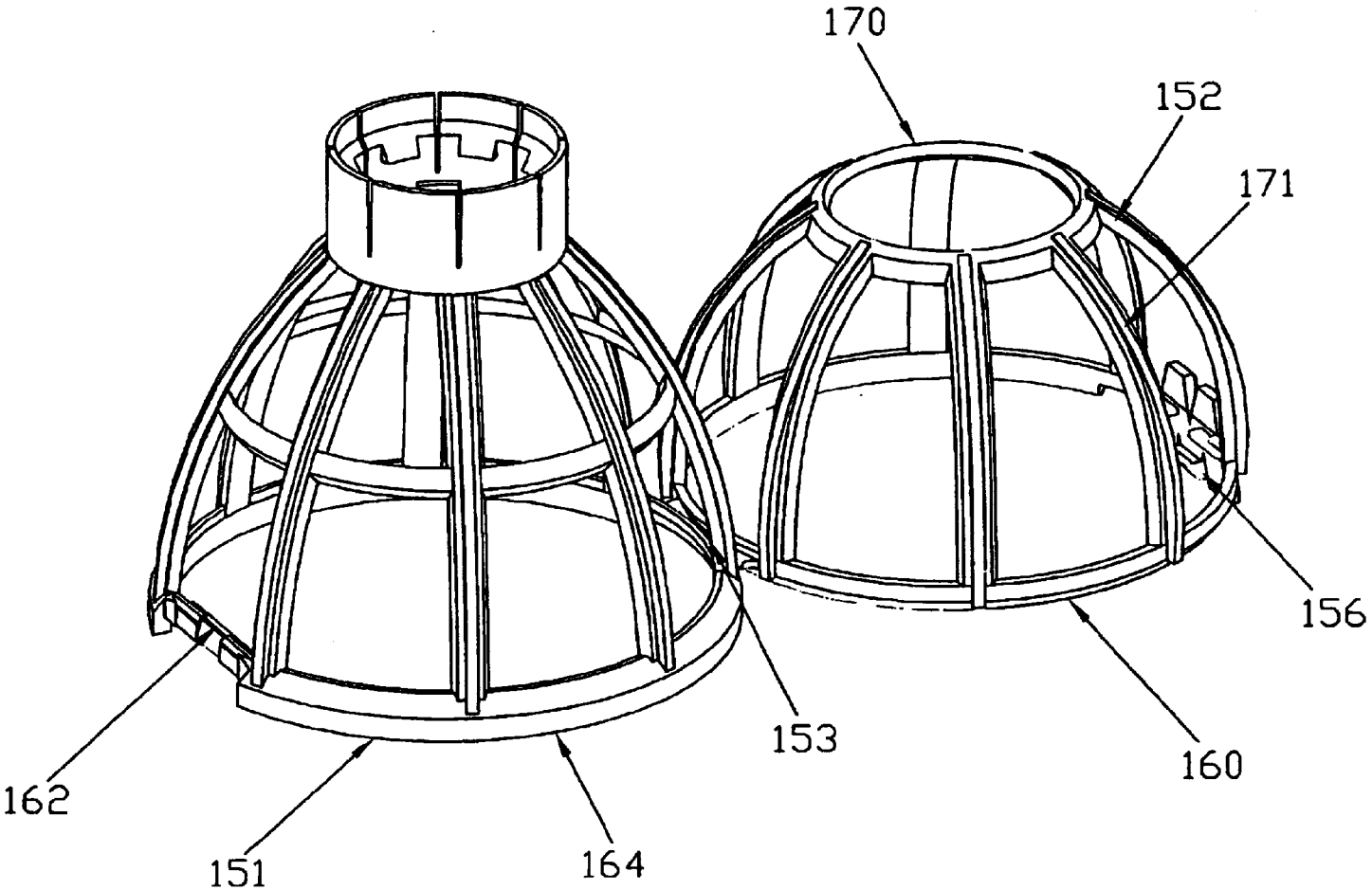
FIG. 6 is a perspective view of the lamp guard in its open position.

Turning now to FIG. 6, the lamp guard 28 includes an upper portion or hemisphere 151 and a lower portion 152 which are in the general form of cage sections with peripheral circular members or rings and vertical vanes interconnected with the rings. The upper and lower hemispheres are connected together by a molded hinge 153, thus permitting the lower portion 152 to be rotated to one side for replacing the lamp as needed. A latch member 156 (which may be integrally molded to a source identifying logo to hide the latch, if desired) secures the upper and lower portions in the closed position of FIG. 5 by engaging a catch bar 162 molded into the larger ring of the upper portion 151 of the lamp guard.

The larger ring of the upper hemisphere 151 is provided with an outer rim 164 which overlaps the circular member 160 of the lower hemisphere 152 when the two sections are latched together. This structure provides a sequential progressive alignment of the two larger rings when closing the lamp guard to facilitate closure, and it preserves the inherent mutual bracing of the larger rings of the lamp guard sections when they are closed, and ensures proper latching. The axial (vertical) length of the assembled lamp guard is greater than its diameter at the mid point to create an overall egg shape (FIG. 1) which adds protective strength against crushing to the structure.

The center of the lower ring 170 of the lower cage section is left open or unobstructed to enhance the transmission of light directly beneath the lamp. As seen at 171, each of the vanes is formed in a general T-shaped cross section including a flat inner portion and a curved outer rib extending in a vertical direction. This structure enhances the lateral strength of the guard while using material efficiently for a given strength.

Having thus disclosed in detail one embodiment of the invention, persons skilled in the art will be able to modify certain of the structure which has been disclosed and to substitute equivalent elements for those described, while continuing to practice the principle of the invention. It is therefore intended that all such modifications and substitutes be covered as they are embraced within the spirit and scope of the appended claims.

We claim:

1. For use in a stringlight assembly including an electrical cord including a plurality of wires each having a conductor and a sheath of insulating material, an improved light assembly comprising:

a cap having a top wall and an integral depending sidewall, said cap defining at least two wire channels within said sidewall and beneath said top wall, each channel elongated in the direction of and receiving an associated wire of said cord;

a screw shell defining a threaded socket for receiving a lamp;

at least first and second contact elements assembled to said screw shell and located to contact a lamp base received in said socket, each contact element defining an insulation-piercing portion aligned with an associated one of said channels when said cap is assembled to said shell, one of said shell and cap including a coupling element to couple firmly to the other of said cap and shell and secure said cap to said shell;

whereby when said wires are placed in respective channels and said cap and shell are assembled said channels secure said associated wires in alignment with an insulation-piercing portions of an associated one of said contact elements to establish electrical continuity with their associated conductors and said cap and shell are mechanically secured together, thereby maintaining electrical continuity between associated contact elements and conductors of said cord while maintaining said wires under securing force between said cap and said screw shell.

2. The apparatus of claim 1 wherein said depending sidewall of said cap is generally cylindrical and defines opposing portions each having a plurality of arched openings defining the ends of said wire channels, said wire channels extending in side-by-side parallel relation within said cap.

3. The apparatus of claim 2 wherein said cap further includes a plurality of elongated walls depending from an underside of said top wall and defining sidewalls of said wire channels, each wire channel engaging approximately 180 degrees of a wire received therein and snugly engaging said wire throughout, whereby when said cap is assembled to said shell, each wire channel firmly engages an associated wire and maintains said engagement after said cap is assembled to said shell.

4. The apparatus of claim 3 wherein at least first and second of said wire channel walls defines a lateral recess adjacent a piercing point of one said contact elements, thereby permitting the sheath of said wire to move laterally into said recess as said piercing portion pierces its associated conductor, under pressure of the assembly of said cap to said shell.

5. The apparatus of claim 4 further including in each of said wire channels, at least first and second recesses formed in the underside of said top wall of said cap and adjacent the location where a piercing point portion of a contact element forms an insulation-piercing contact with an associated wire, thereby permitting the insulation of said wire to move into said recesses under pressure of the assembly of said cap to said screw shell.

6. The apparatus of claim 5 characterized in that said cap and said screw shell cooperate to define three wire channels extending therethrough, including a first wire channel for a hot wire, a second wire channel for a ground wire and a third wire channel for a neutral wire, said ground wire channel being located between said first and third wire channels and extending generally along a diameter of said top wall of said cap, and further including a second set of first and second recesses in the under side of said top wall, said second and fourth sets of recesses being located symmetrically relative to the center of said cap, said cap being characterized as being symmetrical about a plane passing through the center of said second wire channel.

7. The apparatus of claim 2 further including an overmold plastic body surrounding and sealing said cap and the lateral sidewall of said screw shell assembled to said cap and the adjacent portions of said cord.

8. The apparatus of claim 7 wherein said overmold defines an extension in opposing relation to said screw shell, said extension defining an aperture for hanging the associated light assembly in a depending relation.

9. The apparatus of claim 1 wherein said screw shell comprises a plastic housing having a generally cylindrical sidewall, and an opening for receiving the base of a lamp, the interior of said sidewall defining a continuous screw thread extending from said opening to the interior of said sidewall, the sidewall of said screw shell defining a pair of axially extending exterior ribs spaced at a pre-determined spacing, said apparatus further comprising a ground contact including a cylindrical band extending about the exterior of said screw shell, and a contact extension received between said exterior ribs of said screw shell and extending between said ribs axially of said screw shell and thence between said screw shell and said cap to define a contact portion, said contact portion defining a piercing point aligned with the center of a wire channel to pierce and establish an electrical continuity with the conductor of a ground wire received in said wire channel.

10. The apparatus of claim 9 wherein said overmold covers said cylindrical band of said ground contact and said extension thereof and seals said wire channels.

11. The apparatus of claim 10 wherein the interior of said screw shell defines a recess in said helical screw thread extending axially of the cylindrical wall of said screw shell, one of said contact elements defining an extension extending downwardly through the base of said screw shell and into said axial recess defined in the interior cylindrical wall thereof thereby to establish electrical continuity with a lamp inserted in said screw shell.

12. The apparatus of claim 11 wherein said second electrical contact includes a contact portion and an extension above the base of said screw shell, said extension defining said insulation-piercing element, said contact portion thereof extending at an acute angle relative to said extension, whereby said first and second electrical contact elements are mechanically polarized and cannot be interchanged in their assembled relation with said screw shell.

13. The apparatus of claim 1 wherein said sidewall of said cap defines an inwardly extending circumferential lip, and wherein the outer cylindrical sidewall of said screw shell defines an outwardly extending ridge to engage with and lock to said inwardly extending lip of said cap when said screw shell and said cap are forced together axially.

14. The apparatus of claim 1 wherein said overmold defines a peripheral rib, said apparatus further including a lamp guard, said lamp guard including a cylindrical attaching portion including a plurality of laterally spaced tabs, each tab defining an inwardly turned lip to couple to said peripheral rim of said overmold to releaseably assemble said lamp guard to said overmold.

15. The apparatus of claim 14 wherein said lamp guard includes an upper portion and a lower portion, each of said upper and lower portions defining a series of spaced ribs extending from one thereof toward the horizontal center of said lamp guard, each of said upper and lower portions defining a peripheral rim adjacent the center thereof, each of said peripheral rims being hingedly connected at one peripheral location, the other peripheral location of each of said rims defining an interconnecting latch member, whereby said upper and lower portions of said lamp guard may be hinged about said hinge member and releaseably coupled together by said latch members.

16. A stringlight assembly including an electrical cord and at least one light assembly coupled to said cord, said light assembly included an overmold having a peripheral flange; and a lamp guard comprising:

an upper section and a lower section hinged together for rotation about a horizontal axis when said light assembly is in a vertical use position;

each of said upper and lower sections including a plurality of generally upright vanes and a plurality of generally horizontal rings interconnected with associated ones of said vanes;

a collar adjacent the upper portion of said upper section including an annular member having a plurality of slits to define a plurality of tabs flexing outwardly when said lamp guard is assembled to said peripheral flange of said overmold to releaseably couple to said overmold; and a molded latch member carried on a ring of one of said sections and releaseably coupling to a catch on a ring of the other of said sections.

17. The apparatus of claim 16 wherein said upright vanes are characterized as having a generally T-shaped cross section, including a generally flat inner portion and a rib extending longitudinally of said inner portion.

18. The apparatus of claim 17 wherein said lamp guard has a vertical extension which is greater than a diameter adjacent the said hinge thereby to provide an egg shape of enhanced resistance to crushing.

19. The apparatus of claim 16 wherein said lower section includes a lower ring interconnected with said vanes thereof and characterized in that the interior of said lower ring is unobstructed to provide a path for unobstructed light directly beneath an associated lamp assembly.

* * * * *